United States Patent [19]

Borel

[11] Patent Number: 4,934,414

[45] Date of Patent: Jun. 19, 1990

[54] DOUBLE-LAYER PAPERMAKING FABRIC

[75] Inventor: Georg Borel, Reutlingen, Fed. Rep. of Germany

[73] Assignee: Hermann Wangner GmbH & Co., KG, Reutlingen, Fed. Rep. of Germany

[21] Appl. No.: 296,731

[22] Filed: Jan. 13, 1989

[30] Foreign Application Priority Data

Jan. 15, 1988 [DE] Fed. Rep. of Germany ..... 3801051

[51] Int. Cl.[5] ..... D03D 25/00

[52] U.S. Cl. ..... 139/383 A; 162/DIG. 1

[58] Field of Search ..... 139/383 A, 413; 162/DIG. 1

[56] References Cited

U.S. PATENT DOCUMENTS

| | | | |
|---|---|---|---|
| 4,564,052 | 1/1986 | Borel | 139/383 A X |
| 4,592,396 | 6/1986 | Borel et al. | 139/383 A |
| 4,739,803 | 4/1988 | Borel | 139/383 A |
| 4,776,373 | 10/1988 | Borel | 139/383 A |

FOREIGN PATENT DOCUMENTS

| | | |
|---|---|---|
| 0044053 | 7/1981 | European Pat. Off. . |
| 0085363 | 1/1983 | European Pat. Off. . |
| 0117856 | 5/1984 | European Pat. Off. . |
| 0227442 | 11/1986 | European Pat. Off. . |
| 3445367 | 8/1986 | Fed. Rep. of Germany . |
| 3635000 | 4/1988 | Fed. Rep. of Germany . |
| 501204 | 2/1939 | United Kingdom . |

*Primary Examiner*—Andrew M. Falik

*Attorney, Agent, or Firm*—Sughrue, Mion, Zinn, Macpeak & Seas

[57] ABSTRACT

A double-layer fabric for the sheet-forming section of a papermaking machine includes an upper layer of transverse threads, a lower layer of transverse threads, and a single system of longitudinal threads which are interwoven with both layers of transverse threads. The transverse threads of the lower layer are woven in pairs in parallel and the transverse threads of the upper layer are positioned above respective pairs of transverse threads.

6 Claims, 3 Drawing Sheets

DOUBLE-LAYER PAPERMAKING FABRIC

BACKGROUND OF THE INVENTION

The invention relates to a double-layer fabric for the sheet forming section of a papermaking machine made up of two layers of transverse threads which are interwoven with a single system of longitudinal threads.

Fabrics for the sheet forming section of a papermaking machine in which the transverse threads are arranged in two layers and are interwoven with a single system of longitudinal threads are generally designated as double-layer sheet forming woven fabrics or, briefly, double-layer forming fabrics. Double-layer forming fabrics brought about a substantial improvement in the sheet forming characteristics as opposed to a single-layer forming fabrics. The longitudinal stability has been substantially improved by the high degree of filling of the longitudinal threads on the order of 95–110%. The dewatering characteristics of these forming fabrics are also more favorable because there are not provided any large openings passing through in the vertical direction, and the water is conducted away from the paper pulp through numerous fine, slot-like openings which are predominantly arranged in an oblique direction.

It is possible in the case of double-layer forming fabrics to select the dimensions, the material characteristics and the shape of crimping of the two weft systems to be different. For reasons having to do with marking, fine transverse threads of relatively short floating length may be used for the paper side, while thick transverse threads having long floatings may be used for the running side. It is possible, furthermore, to utilize different materials for the running side. It is customary for the transverse threads of the running side to consist alternatingly of polyester and abrasion-resistant polyamide.

A two-layer forming fabric is understood to be, by contrast, a fabric for the sheet forming section of a papermaking machine, which consists of an upper fabric and a lower fabric, each of which are woven complete in themselves from longitudinal threads and transverse threads with upper fabric and the lower fabric being connected either by means of specific binding threads or by means of weaving of the longitudinal or the transverse threads of the upper fabric into the lower fabric or vice versa. The upper fabric is fine-meshed in nature. It consists of a plurality of thin threads and has little stability in itself. The lower fabric is coarse and consists of thick threads. It imparts to the woven fabric the required longitudinal and transverse stability. The binder threads may extent in a longitudinal direction, in a transverse direction or simultaneously in both directions.

The binder thread is the weak point of these two-layer forming fabrics. It frequently is destroyed prematurely due to abrasion from the running side or due to internal friction between the two layers of woven fabric. U.S. Pat. No. 4,592,396 offers a remedy for this. This forming fabric is provided on the running side with transverse threads arranged pairwise and the binding thread no longer lies on the running surface but is nipped by a pair of transverse threads and retained over against the longitudinal thread crossing thereabove. In the case of two-layered forming fabrics, the connection of the two layers to one another is not strong enough for avoiding mutual relative movement. In the event of alternating deflection of the forming fabric via externally-disposed and internally-disposed guide rollers, there results internal friction between the two layers of woven fabric.

Due to the high proportion of filler materials in paper for writing and in paper for printing, the abrasive particles of the filler get in between the two layers of woven fabric. The face between the two layers of woven fabric is also highly abraded on account of the relative movement and the filler material. The binding threads are often prematurely chafed through at the points of contact with the layers of woven fabric. As a result of this, the layers of woven fabric are separated and the forming fabric becomes unserviceable.

U.S. Pat. No. 4,739,803 describes a forming fabric, which is similar to the double-layer forming fabric but has the finer surface structure of a two-layer forming fabric. The structure on the paper side is made to be very fine due to a specific longitudinal thread path and due to the number of transverse threads having been doubled. The running side of this forming fabric is, by contrast, coarse and very open. Furthermore, successive transverse threads on the paper side are supported in a different manner in that one transverse thread is carried in saddle-like manner by the longitudinal thread, so that it is lying precisely in a transverse direction in the woven fabric, while the next-following transverse thread is supported by two adjacent longitudinal threads, one of said longitudinal threads rising to the forming fabric surface and the other one descending, so that the supporting of the transverse thread takes place in a shear-like manner and the transverse thread floating is turned in a manner such that it lies at an angle with respect to the floatings of the transverse threads supported in a saddle-like manner. In this way, the marking characteristics of the forming fabric are substantially improved. The number of transverse threads in the case of this forming fabric is twice as high on the paper side as on the running side. It is in that way possible to achieve substantially higher numbers of transverse threads on the paper side than in the case of a conventional, double-layer forming fabric (with a similar degree of fineness of the longitudinal threads). The maximum possible number of transverse threads is limited in the case of double-layer forming fabrics on account of weaving technique because the longitudinal threads always alternate between the upper and lower layer, so that only a limited total number of transverse threads can be shot-in. With a similar total number of transverse threads, the forming fabric according to U.S. Pat. No. 4,739,803 has more threads on the paper side than a conventional forming fabric because the number of threads on the running side is only half as large as that on the paper side.

According to EP-A-O No. 0 085 363, the marking characteristics and the retention of the fibers are improved in that an additional supporting thread is inserted without binding it in subsequent to each structural thread in a single-layer or on the paper side of a double-layer forming fabric. This serves to reduce the mesh size and the fibers of the paper pulp are better supported. For reasons having to do with weaving technology, it is not possible, however, to still weave-in further, additional threads once a maximum possible thread density of the double-layer forming fabric has been attained. The number of transverse threads of the original weave construction must be reduced by about one-third in order to arrive, with additional threads, at about the same total number of transverse threads.

It has turned out in practice that the forming fabrics according to the EP-A-O No. 0 085 363 and U.S. Pat. No. 4,739,803 substantially improve the forming fabric marking and retention. Care must be taken, however, upon weaving of these double-layer woven fabrics that the transverse threads are lying perfectly one above the other. This presents problems because the position of the upper and the lower threads relative to one another changes on account of the crimping exchange phenomena occurring during heat setting. During weaving, the transverse threads are still laid in substantially uncrimped state into the composite structure of the longitudinal threads. The longitudinal threads are looped around the two layers of the inserted transverse threads and initially form the outermost points of the woven fabric on the paper side as well as also on the running side. It is only upon heat setting at very high longitudinal tension and with the action of heat that the longitudinal threads are stretched and force the transverse threads to crimp. There is thus formed, for instance, the long transverse thread floating on the running side, which in the finished forming fabric extends out of the plane of the woven fabric and defines the abrasion surface of the forming fabric. This is then called the weft runner. At the same time the longitudinal thread is on account of the high longitudinal tension urged to the inside of the woven fabric. It is in that way protected from abrasion on the running side or is at least exposed to abrasion only after the volume of the transverse threads has already largely been spent. Simultaneously with these crimp exchange phenomena, the transverse threads slip above one another, and it is extremely difficult to weave the woven fabric in a manner such that all of the transverse threads are lying perfectly above one another over the full length and width of the forming fabric.

In the case of a forming fabric having a width of 9 meters and having 70 longitudinal threads/centimeter, the forming fabric has, in all, 63,000 longitudinal threads. When the number of transverse threads is 30 transverse threads/cm in the upper layer and 30 transverse threads/cm in the lower layer a forming fabric having a length of 45 meters has 135,000 transverse thread pairs in all. In the case of a 7-harness weave, the result is 1215 million transverse thread floatings which must all be lying one neatly above the other. If slippage of one upper transverse thread relative to a lower one occurs at only a single location, then this location will cause, at the high operating speeds of the forming fabrics, an inadmissible marking on the paper web, and the entire forming fabric will become unserviceable.

It is extraordinarily difficult to attain, with so many longitudinal threads and so many transverse thread pairs, a perfect super-position which really does remain the same. The fabric tension must already upon weaving be maintained precisely over the full width of the loom and, of course, over the full length of the forming fabric. Furthermore, all of the transverse threads must have exactly the same characteristics in the cold state upon weaving as well as also at the high temperatures during the setting procedure. For the woven fabric to become resistant to abrasion, polyester threads and polyamide threads are alternatingly woven into the fabric on the running side. These two working materials exhibit very different behavior, especially upon setting. If a good super-position of the upper transverse thread above the lower transverse polyester thread is attained, then the next upper transverse thread slips off of the transverse polyamide thread disposed below it. Minor offsets already bring about very distinct markings in the paper. Furthermore, the polyamide monofilament crimps under tension and the action of heat in a different way than does the polyester monofilament. This depends upon temperature and tension. The result is that the longitudinal thread on the running side, when the polyamide thread is woven in, is embedded less deeply within the woven fabric than when the polyester threads are interlaced. While it is possible to reduce these crimping differences by selecting physical characteristics that are as favorable as possible, it is nevertheless not possible to entirely avoid these differences in the inner structure of the forming fabric.

These problems are encountered in the production of all double-layer forming fabrics. They are particularly serious in the case of the forming fabric constructions according to EP-A-O No. 0 085 363 and U.S Pat. No. 4,739,803 wherein the inner structure is from the very outset less balanced due to the absence of every second transverse thread on the running side. Slipping off of the transverse threads is a phenomenon that is particularly marked in the case of these woven fabrics.

In addition, the number of transverse threads on the running side is less in the case of these forming fabrics and on account of that the distances between transverse threads are substantially greater than in the case of double-layer forming fabrics having a like number of transverse threads in the upper and in the lower layer. Considering that at the high speed of modern papermaking machines for printing paper of greater than 1000 m/min. hydrodynamic pressure waves, which go out from the running side, have a decisive influence on marking, the large distance between transverse threads on the running side has a disadvantageous effect in regard to marking. The intensity of the pressure waves depends upon the distance between successive trans-Verse threads. When woven fabrics with only half the number of transverse threads on the running side are used, it sometimes happens that insupportably extensive transverse thread markings become visible in the paper web. The density of the lines of the marking in the paper web is not such as to correspond to each lower transverse thread but, rather, only to every second transverse thread on the running side; this is the transverse polyamide thread. The causes for this are the above-described differences in the super-positioning (slipping-off) and the crimping differences between polyamide and polyester. In some instances, the otherwise so interesting advantages which these forming fabrics provide for are in this way brought to nothing.

Another negative factor encountered by woven fabrics having a low number of transverse threads on the running side is entrainment of water. These woven fabrics are closed on the paper side but very open at the bottom. Larger quantities of water are retained in the open space of the woven fabric openings and are then flung-out upon the deflection over guide rollers.

It is known from German application No. DE-A-31 46 385 to improve retention in the case of a double-layer papermaking machine forming fabric in that the longitudinal threads on the paper side and/or on the running side are conducted at least over some distance in parallel pairwise. The parallel guiding of the longitudinal threads is of a nature such that the threads of the paper web are supported by way of an areal structure, thus avoiding the distinct impressions of individual longitudinal threads upon the paper web.

EP-A-O No. 117 856 describes a two-layer papermaking machine forming fabric, in which the warp threads of the lower layers are interwoven pairwise in parallel over the entire extent thereof. It is made possible thereby to produce, on the one hand, double-layer papermaking machine forming fabrics and, on the other hand, two-layer papermaking machine forming fabrics with warp threads of like diameter in the same warp thread density.

A two-layer papermaking machine forming fabric is known from German Application No. DE-A-34 45 367, in which the lower woven fabric contains, for the purpose of avoiding high tensions in the binding threads, two groups of transverse threads, the first group of which being interwoven in a 1:1-weave and the second group in a 1:n-weave with the warp threads of the lower Woven fabric, with successive transverse threads of varying weave construction, which define double crimpings on the inner side of the lower woven fabric, contacting, and with the long n-crimps defining on the outer side a plane of wear. In that respect, n denotes an odd number greater than 1.

SUMMARY OF THE INVENTION

The invention solves the problem of designing a double-layer papermaking machine forming fabric in a manner such that the danger of slippage of the upper transverse threads relative to the lower transverse threads is substantially reduced.

This problem is solved according to the invention in that the lower transverse threads are woven in pairs in parallel, and in that one transverse thread of the upper layer is positioned above each pair of transverse threads in the lower layer. One transverse thread of the upper layer may, in addition, also be disposed between each transverse thread pair in the lower layer.

The forming fabric according to the invention is produced in a manner such that there are interwoven, in lieu of one lower transverse thread, two transverse threads of about a 20% to 30% smaller diameter, but otherwise includes unchanged features of construction. Therefore, the number of transverse threads in the lower layer has been doubled as opposed to the forming fabrics according to EP-A-O No. 085 363 and U.S. Pat. No. 4,739,803. Surprisingly, the doubling of the number of transverse threads in the lower layer does not require any reduction in number of transverse threads in the upper layer. Hence, each transverse filament pair of the lower layer has the effect only of that of a single transverse thread on the number of transverse threads attainable overall.

In the production of the forming fabric according to the invention, the weaving sequence is of a nature such that there is interwoven one lower transverse thread of one pair, then there is interwoven an upper transverse thread and, finally, the other transverse thread of the pair is interwoven. Hence, the two transverse threads of the bottom layer are not interwoven directly in succession but, rather, the upper transverse thread is interwoven in between.

In addition to improving the stability of the forming fabric structure, the resistance to abrasion also is increased in the case of the forming fabric according to the invention, as the entire volume of transverse threads in the lower layer available for abrasion is higher. If there are, for instance, interwoven two transverse threads of a thickness of 0.18 mm each, in lieu of one transverse thread of a thickness of 0.22 mm, then the volume of material of the lower transverse threads is increased, overall, by about 34%. The result of this is an improvement in resistance to abrasion and, on account of that, an increase in the service life.

It generally applies that the diameter of the lower transverse threads is at least equal to that of the upper transverse threads, and that it may be up to 30% larger.

As has been mentioned at the outset, it is customary in the case of papermaking machine forming fabrics to use on the running side alternately transverse threads of a different material, in particular, alternatingly polyamide and polyester. In the forming fabric according to the invention, each pair of transverse threads consists preferably of one polyester thread and one polyamide thread, generally of a polyester monofilament and a polyamide monofilament. In that way, each longitudinal thread always binds the same combination of transverse threads each time it is looped around the transverse threads on the running side. It is on account of this that there are no longer any differences between the individual longitudinal thread crimps on the running side and the uniformity of the running side is substantially improved. The varying characteristics of the materials which the transverse threads are made of, namely polyamide and polyester, no longer have any disadvantageous effects. Due to the lower thickness of the bottom transverse threads as compared with a papermaking machine forming fabric having otherwise unchanged features of construction, the thickness of the lower layer is also reduced and simultaneously the open area of the lower layer diminished. The distances between the transverse thread pairs are decreased on account of that, thus further reducing the danger of marking.

The forming fabric according to the invention and the upper woven fabric of the multi-layer forming fabric according to the invention otherwise exhibit features typical of a double-layer forming fabric. In particular, the upper transverse threads are finer than the lower transverse threads, the difference being, however, not as distinct as in the case of prior art, as in the case of the forming fabric of the invention each individual lower transverse thread is thinner than what is customarily the case. The longitudinal threads and the transverse threads generally are monofilaments. The upper transverse threads and the longitudinal threads as a rule are polyester-monofilaments. The forming fabric may be woven flat or endless. The longitudinal threads, for instance, may be multi-filaments particularly in the case of an endless weave. The forming fabric for papermaking machines according to the invention may be woven in any number of harnesses. A seven-harness, an eight-harness, a ten-harness, a fourteen-harness or a sixteen-harness weave is, in particular, expedient.

Transverse threads interwoven pairwise are known in the case of single-layer and two-layer or multi-layer papermaking machine forming fabrics. There does not, however, exist in the case of these papermaking machine forming fabrics any danger of displacement of transverse threads that are positioned vertically above one another, or else such a displacement does not have any serious influence on the marking characteristics. Multi-layer forming fabrics with transverse threads conducted in parallel pairwise in one of the layers are known from the U.S. Pat. Nos. 4,636,426 and 4,592,396. In the former case, the two transverse threads of a pair are bound to one another over their entire length through a hydrophilic, water-absorbing polyester, so that the two transverse threads act as a single thread having a flat cross-section. In the second instance, what is concerned is a two-layer forming fabric, in which the transverse threads of the lower layer are conducted pairwise in parallel so as to enclose between themselves and the crossing longitudinal thread a transverse binder thread, so that said transverse binder thread is largely out of the way of any abrasion.

DETAILED DESCRIPTION OF THE INVENTION

Figure 1:
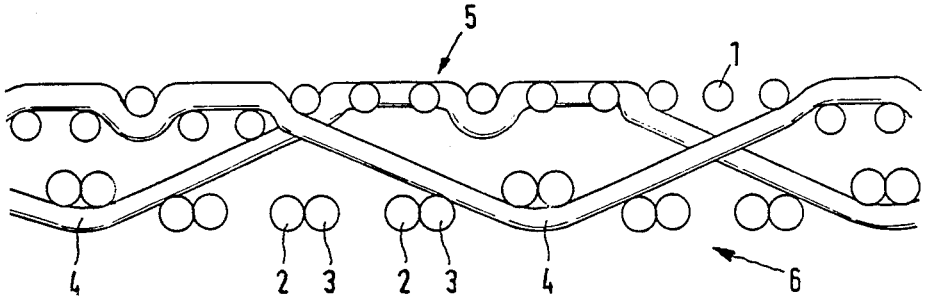
FIG. 1 is a sectional view in the longitudinal direction of a forming fabric with lower transverse threads interwoven pairwise in parallel.
Figure 4:
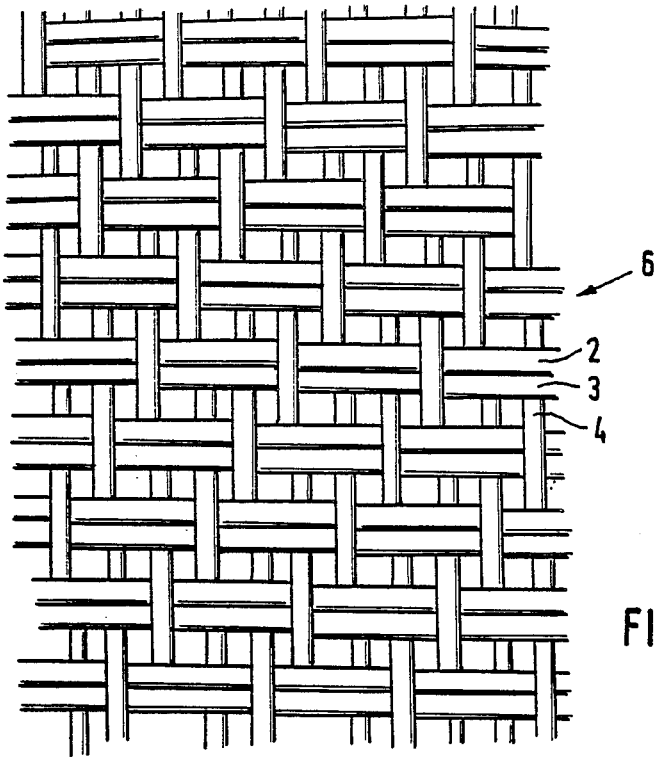
FIG. 4 is a view of the running side of the forming fabric according to FIG. 1.

The double-layer forming fabric shown in FIGS. 1 and 4 comprises upper transverse threads 1 and lower transverse threads 2 and 3 which are woven in pairs in parallel and are interwoven with longitudinal threads 4. The upper transverse threads 1 form, together with the longitudinal threads 4, the paper side 5 of the forming fabric, on which sheet formation takes place. The lower transverse threads 2 and 3 define the running side 6 of the forming fabric which faces most of the rollers and the guidance elements of the papermaking machine. The longitudinal thread 4 generally do not take part in the formation of the running side since they are important with respect to the longitudinal stability of the papermaking machine forming fabric and should, on account of that, be exposed as little as possible to any abrasion. In the production of the forming fabric, this is achieved in that there is exerted, upon thermo-setting, a correspondingly high lengthwise tension into the forming fabric, so that the lower crimps of the longitudinal threads 4 are drawn upwardly.

Figure 2:
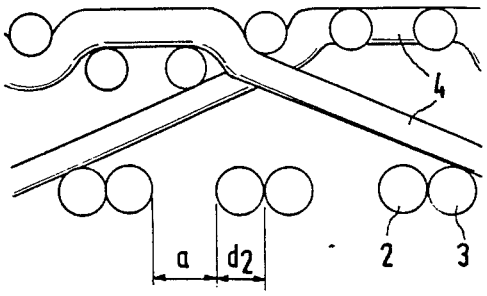
FIG. 2 is an enlarged cutaway portion of FIG. 1.

The forming fabric illustrated in FIGS. 1 and 4 coincides substantially with the papermaking machine forming fabric according to FIGS. 1 and 2 and Example 1 of U.S. Pat. No. 4,739,803, with the exception, however, of the paired lower transverse threads 2, 3. The papermaking machine forming fabric was produced with the following data, in which respect there have been indicated, as far as relevant, the values subsequent to weaving and thermo-setting:

| | |
|---|---|
| Diameter of the longitudinal threads | 0.17 mm |
| Density of the longitudinal threads | 54/61 per cm |
| Diameter of the upper transverse threads | 0.17 mm |
| Density of the upper transverse threads | 34/32 per cm |

-continued

| | |
|---|---|
| Material of the upper transverse threads and of the longitudinal threads: | Polyester |
| Diameter of the lower transverse threads | 0.18 mm |
| Density of the lower transverse threads | 17/16 pairs per cm |
| Material of the lower transverse threads | Polyester and polyamide 6.0 alternatingly |
| Thickness of the woven fabric | 0.674 mm |
| Free distance a (FIG. 2) of the lower transverse threads | 0.265 mm |

When the same forming fabric is produced respectively with a single lower transverse thread of a diameter of 0.22 mm instead of with a pair of transverse threads of a diameter of 0.18 mm, the thickness of the woven fabric is 0.716 mm and the free spacing between the lower transverse threads 0.405 mm. It will be recognized from this that in the case of the papermaking machine forming fabric according to the invention the lower layer is distinctly thinner and no longer as extremely open.

Figure 3:
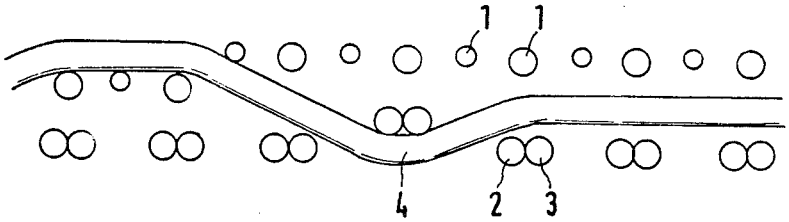
FIG. 3 is a sectional view in the longitudinal direction of another embodiment of a double-layer forming fabric with lower transverse threads interwoven pairwise in parallel.

FIG. 3 shows another exemplary embodiment with another weave construction, in which the upper layer of transverse threads 1 consists alternately of polyester-monofilaments of a diameter of 0.11 and 0.18 mm. The remaining design features are unchanged as concerns the state subsequent to weaving as well as the state subsequent to thermo-setting.

Figure 5:
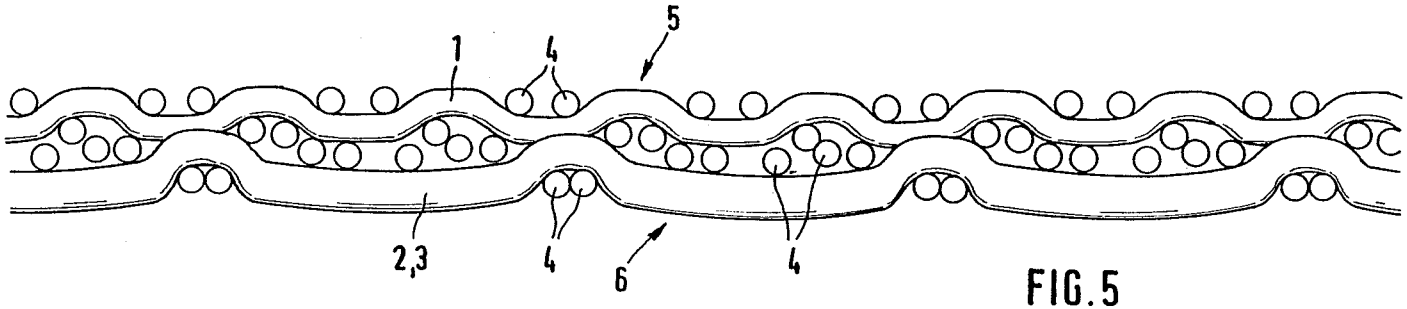
FIG. 5 is a cross-sectinal view of a further embodiment of a double-layer forming fabric with lower transverse threads interwoven pairwise in parallel.
Figure 6:
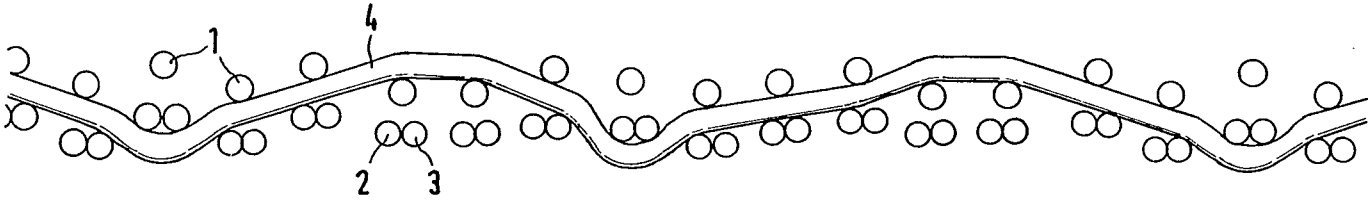
FIG. 6 is a longitudinal sectional view of the further embodiment shown in FIG. 5.

FIGS. 5 and 6 pertain to still another exemplary embodiment, in which the double-layer papermaking machine forming fabric disclosed in FIGS. 5*a* and 5*b* of EP-A-O No. 245 851 was modified in accordance with the subject invention in that each one of the transverse threads of the lower layer was substituted by a pair of transverse threads interwoven in parallel.

Figure 7:
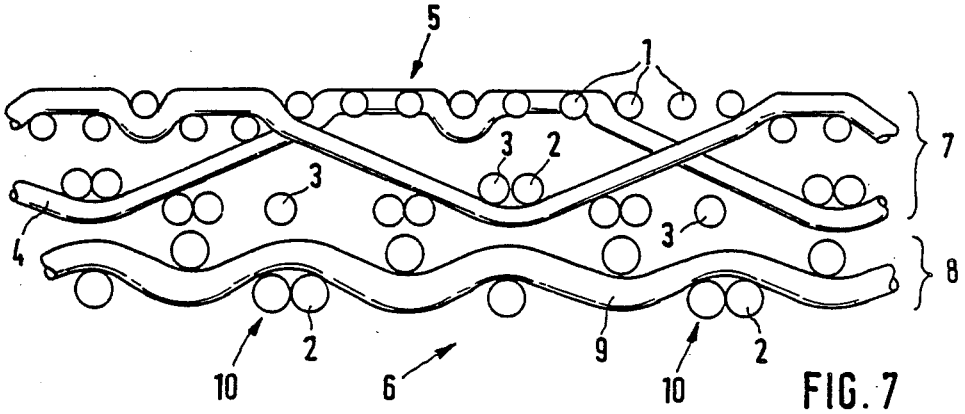
FIG. 7 is a longitudinal sectional view of an embodiment of a multi-layer forming fabric, in which the upper layer is a double-layer woven fabric, which corresponds to the forming fabric depicted in FIG. 1.

The subject invention also covers embodiments, in which the uppermost woven fabric 7 of a multi-layer forming fabric is defined by a woven fabric, which corresponds to one of the above-described double-layer forming fabric (FIG. 7). In that regard, the upper woven fabric 7 is connected to the lower woven fabric 8 by means of one transverse thread 2 of a pair of transverse threads conducted in parallel which is interwoven with a longitudinal thread 9 of the lower woven fabric 8. The structure of the upper woven fabric 7 is in that respect not adversely affected at the binding sites 10 between the two woven fabrics 7, 8, since the longitudinal thread 4 of the upper woven fabric 7 follows the course it normally follows on account of the fact that the course of the other transverse thread 3 has not been changed. As a result of this, there are no depressions on the paper side 5 at the binding sites which would result in a noticeable marking in the paper. It is also possible to utilize a double-layer woven fabric as the lower woven fabric, in lieu of the single-layer woven fabric which is shown in FIG. 7.

What is claimed is:

1. A double-layer fabric for the sheet forming section of a papermaking machine, comprising an upper layer of transverse threads (1) and a lower layer of transverse threads (2, 3) and including a single system of longitudinal threads (4), which are interwoven with both layers of transverse threads (1, 2, 3), wherein said transverse threads (2, 3) of said lower layer are woven in parallel in pairs wherein the transverse threads of each pair are always running adjacent to each other and are never separated by a longitudinal thread passing between them and with one transverse thread (1) of the upper layer being positioned above each transverse thread pair (2, 3) in the lower layer.

2. A double-layer fabric according to claim 1, wherein one transverse thread of each transverse thread pair (2, 3) is a polyester-monofilament and the other transverse thread of said thread pair is a polyamide-monofilament.

3. A double-layer fabric according to claim 1, wherein the number of upper transverse threads (1) is equal to the number of lower transverse threads (2, 3).

4. A double-layer fabric according to claim 3, wherein the diameter of the lower transverse threads (2, 3) is about 30% larger than the diameter of the upper transverse threads (1).

5. A double-layer fabric according to claim 1, wherein the number of upper transverse threads (1) is half as large as that of said lower transverse threads (2, 3), and said upper transverse threads (1) and said lower transverse threads (2, 3) have about the same diameter.

6. A multi-layer fabric for the sheet forming section of a papermaking machine, comprising an upper woven fabric and at least one lower woven fabric connected therewith, wherein said upper woven fabric is a double-layer fabric comprising an upper layer of transverse threads, a lower layer of transverse threads and a single system of longitudinal threads which are interwoven with both layers of transverse threads with said transverse threads of said lower layer being woven in parallel in pairs with the transverse threads of each pair always running adjacent to each other and never separated by a longitudinal thread passing between them and with one transverse thread of the upper layer being positioned above each transverse thread pair in the lower layer and wherein said upper woven fabric is connected to the lower woven fabric by means of one of the transverse threads of a plurality of said pairs of transverse threads of said upper woven fabric which are interwoven with a longitudinal thread of said lower woven fabric.

* * * * *